United States Patent [19]

Sato et al.

[11] Patent Number: 4,627,350

[45] **Date of Patent: * Dec. 9, 1986**

[54] CONVERTIBLE INK SCRAPER DEVICE CORRESPONDING TO REVERSE-ROTATABLE MESH ROLLER

[76] Inventors: Masayoshi Sato, 76-3, Mukaigaoka, Takatsu-ku, Kawasaki 213; Noritake Harada, 5408-57, Hino, Konan-ku, Yokohama 233; Kunio Suzuki, 4-11 Ichiba-Shita-machi, Tsurumi-ku, Yokohama 230, all of Japan

[ * ] Notice: The portion of the term of this patent subsequent to Dec. 18, 2001 has been disclaimed.

[21] Appl. No.: 549,997

[22] Filed: Nov. 8, 1983

[51] Int. Cl.[4] ..... B41F 31/00

[52] U.S. Cl. ..... 101/350; 101/169; 101/178

[58] Field of Search ..... 101/350, 363, 364, 157, 101/169, 178

[56] References Cited

U.S. PATENT DOCUMENTS 4,488,483 12/1984 Kohara ..... 101/350 X

FOREIGN PATENT DOCUMENTS 58-51153 3/1983 Japan .

*Primary Examiner*—Edgar S. Burr
*Assistant Examiner*—Moshe I. Cohen

[57] ABSTRACT

A pair of first and second doctor blades are disposed in symmetrical locations one on each side of a location in which a mesh roller is disposed adjacent to a fountain roller.

There is switching means for independently displacing the pair of doctor blades between a first position in which the doctor blades are pressed against the mesh roller and a second position in which the doctor blades are spaced from the mesh roller, with or without a safety circuit.

3 Claims, 11 Drawing Figures

CONVERTIBLE INK SCRAPER DEVICE CORRESPONDING TO REVERSE-ROTATABLE MESH ROLLER

BACKGROUND OF THE INVENTION

The present invention relates to a convertible ink scraper device for a reverse-rotatable mesh roller of the type which supplies ink to a plate cylinder of a printing unit and is capable of rotating selectively in normal and reverse directions, in a printing system changeable between two printing modes of which, one is monotone printing on both sides of a web, the other is two color printing on a one side of the web. The said printing system consists of a pair of printing units each having a plate cylinder and a impression cylinder, one of which is capable of rotating selectively in normal and reverse direction. More particularly, the invention relates to the ink scraper device being able to change a scraping position and direction of a doctor blade in which the distal edge thereof has been pressed on the peripheral surface of the mesh roller, corresponding to changed rotative directions of the mesh roller and the plate cylinder.

The doctor blade is provided so as to touch at the reverse angle against the rotative direction of the mesh roller, so that the ink on the peripheral surface thereof can be scraped by the doctor blade.

It is required to change not only a direction of the blade touching on the mesh roller, but also a position of the blade touching on the mesh roller, according to that the mesh roller can be rotated in normal and reverse direction.

SUMMARY OF THE INVENTION

The first object of the present invention is to provide a convertible ink scraper device in which a conversion mechanism of the doctor blade being speedy, simple, low cost, and easy to use, inspect, repair or exchange.

The second object of the present invention is to provide a convertible ink scraper device having a safety means which permits drive actuation only when changing operation of both the mesh roller and the doctor blade have been completed.

Briefly summarized, a pair of first and second doctor blades are disposed in symmetrical locations one on each side of a position in which a mesh roller is disposed adjacent to a fountain roller. There is switching means for independently displacing the pair of doctor blades between a first position in which the doctor blades are pressed against the mesh roller and a second position in which the doctor blades are spaced from the mesh roller, with or without a safety circuit.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
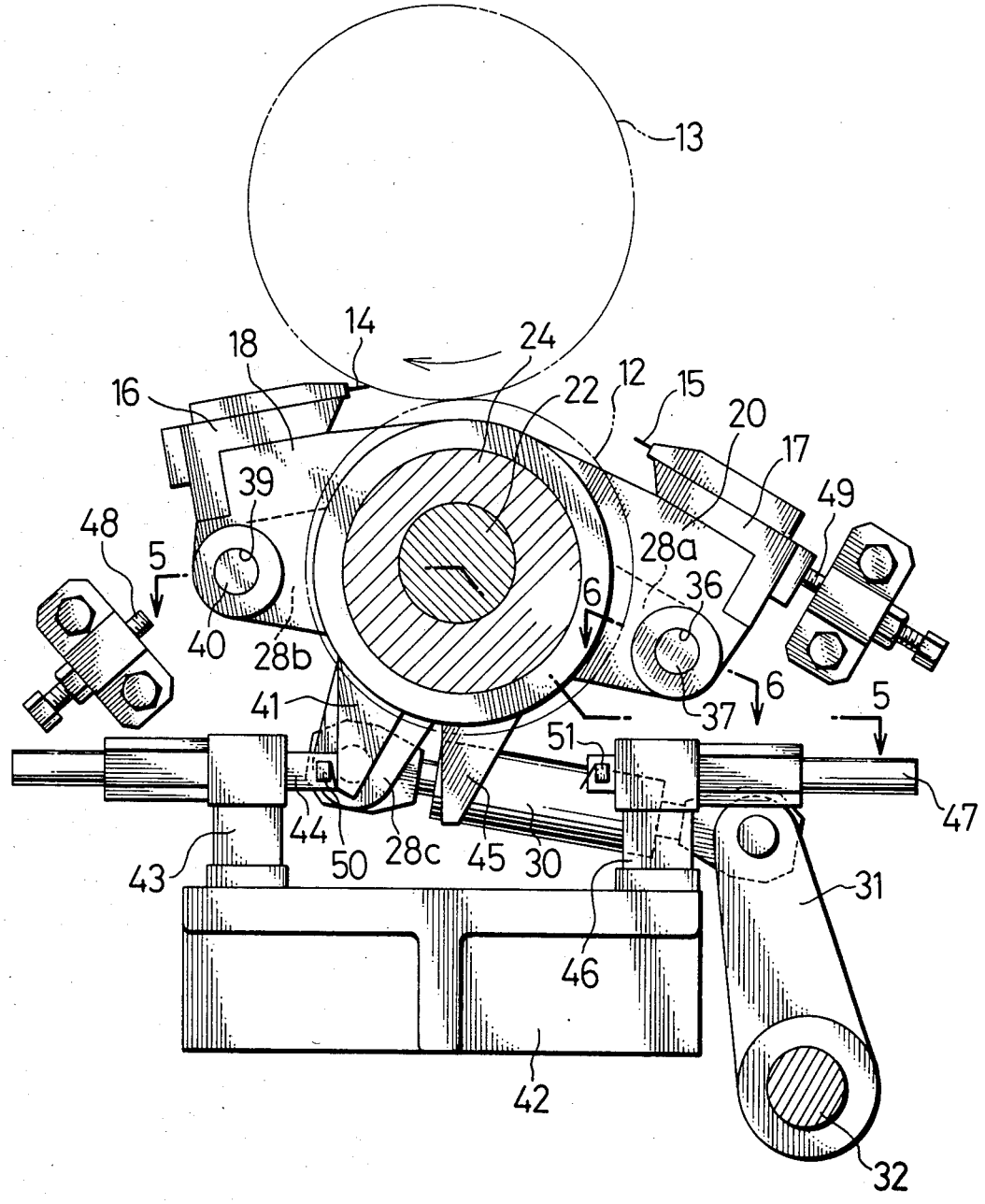
FIG. 1 is a vertical cross-sectional view taken in the plane of line A—A of FIG. 5 in which a pair of doctor blades are individually displaceable, the lefthand doctor blade for normal rotation being shown in contact with a mesh roller rotating in a normal direction.

Ink is picked up from an ink pan (not shown) by a fountain roller 12. A mesh roller 13 is spaced slight distances from the fountain roller. The mesh roller has a peripheral surface made of special steel and engraved with a mesh-like pattern of minute recesses such as of a 250 mesh, the engraved peripheral surface being coated with a placed layer of chromium for increased resistance to wear.

A pair of doctor blades 14, 15 is disposed in symmetrical locations one on each side of a central position in which the mesh roller 13 is placed adjacent to the fountain roller 12, the doctor blades having distal ends held against the peripheral surface of the mesh roller.

As shown in FIGS. 1 through 4, each of the doctor blades is individually displaceable through an angular interval between a position in which the doctor blade is pressed against the mesh roller and a position in which the doctor blade is spaced from the mesh roller. Such an operation will be described later in detail.

One of the doctor blades which is pressed against the mesh roller has a bearing on the direction of rotation of the mesh roller. When the mesh roller rotates clockwise (hereinafter referred to as "normal rotation"), the doctor blade 14, shown lefthand, is pressed against the mesh roller and the doctor blade 15, shown righthand, is retracted out of contact with the mesh roller. When the mesh roller rotates counterclockwise (hereinafter referred to as "reverse rotation"), the righthand doctor blade 15 is pressed against the mesh roller, and the lefthand doctor blade 14 is spaced from the mesh roller. Therefore, the doctor blade as oriented at a reverse angle, that is, in a direction opposite to the direction of rotation of the mesh roller, is pressed against the peripheral surface thereof, and the other doctor blade as oriented in a forward direction is spaced from the mesh roller.

The ink transferred to the mesh roller is scraped off therefrom by the doctor blade contacting the mesh roller in a direction against its rotation except for those ink layers which are trapped in the recesses in the mesh roller, the scraped ink being returned to the ink pan. Since any excessive ink is removed at the mesh roller and therefore not allowed to be fed along to downstream components, therefore, the rollers positioned downstream of the mesh roller will not scatter ink mists around.

The ink layer trapped in the recesses in the mesh roller is permitted to be supplied to a plate cylinder (not shown) through inking rollers (not shown).

The ink which has reached the plate cylinder is extended by the coaction of the mesh roller and the doctor blade into a uniform coating having a constant thickness, so that the plate cylinder is supplied with an optimum amount of ink at all times.

With the foregoing arrangement, many ink distributing rollers and ink extending rollers which have been required by the conventional printing presses are no longer necessary, and the number of inking rollers needed is only about $\frac{1}{3}$ through $\frac{1}{4}$ of that of prior inking rollers.

FIGS. 1 through 11 illustrate means for bringing the righthand and lefthand doctor blades 14, 15 into and out of contact with the peripheral surface of the mesh roller 13.

Figure 7:
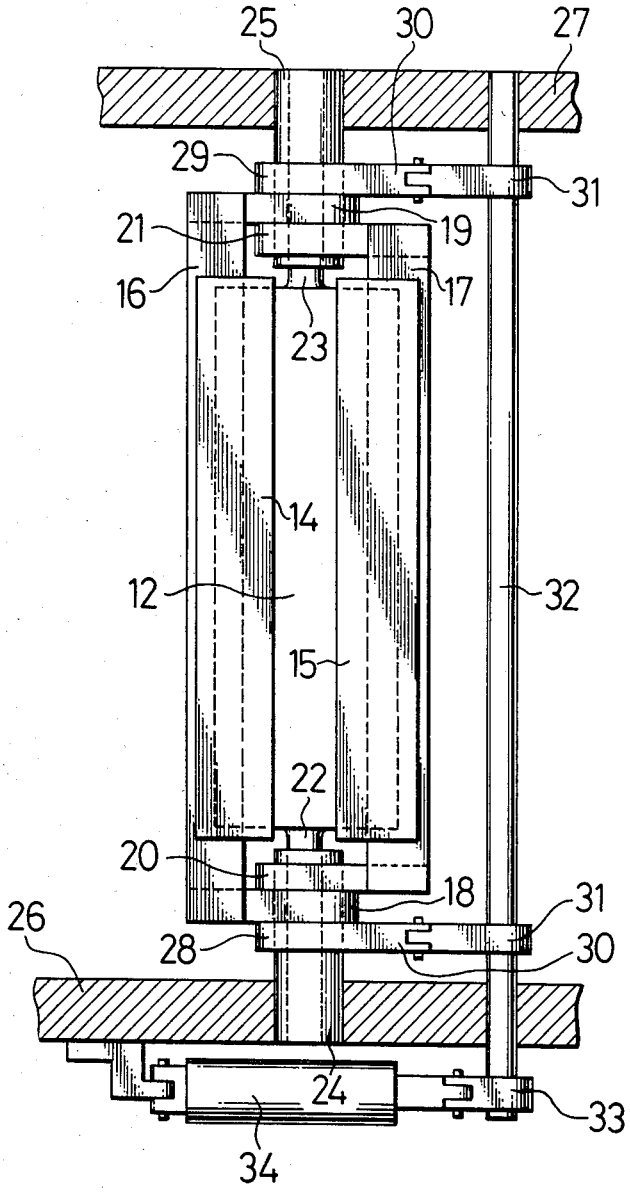
FIG. 7 is a horizontal cross-sectional view taken along line 7—7 of FIG. 2 but showing both doctor blades in their respective positions for engaging the mesh roller.

The doctor blades 14, 15 are fixed respectively to mount bases 16, 17 having opposite ends securely supported on distal ends of support arms 18, 19, 20 and 21, as shown in FIG. 7. Each of the support arms has an annular proximal portion fitted rotatably over the peripheral surfaces of eccentric sleeves 24, 25 that carry therein opposite shafts 22. 23 of the fountain roller 12. The fountain roller 12 is supported by the eccentric sleeves 24, 25 by side frames 26, 27.

Figure 8:
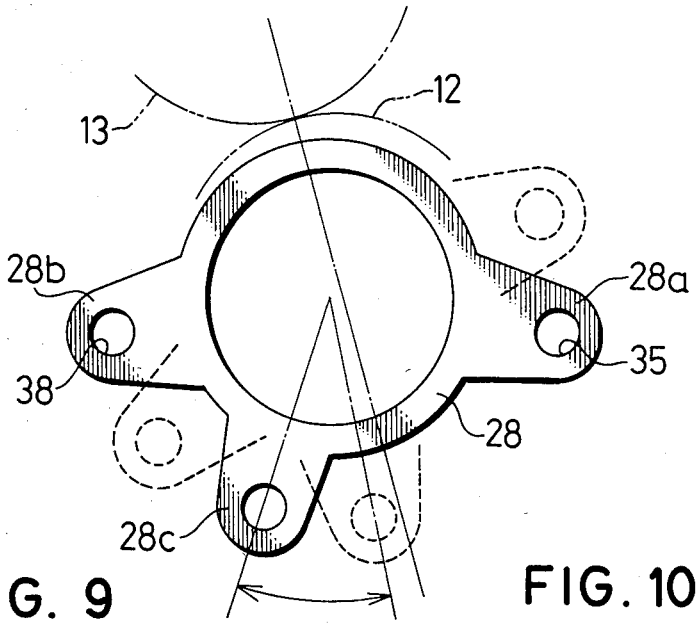
FIG. 8 is a front elevational view of a trifurcate arm for switching between normal and reverse rotations.
Figure 9:
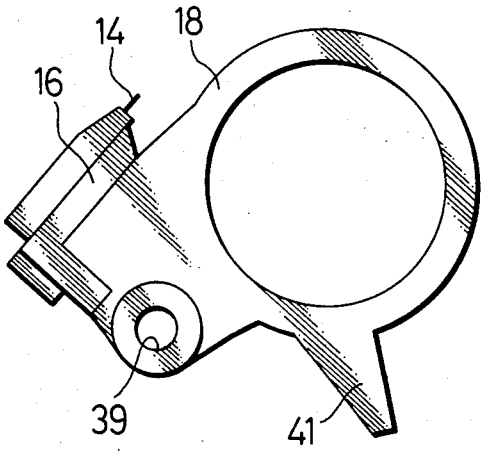
FIG. 9 is a front elevational view of a support arm for the lefthand doctor blade for normal rotation.
Figure 10:
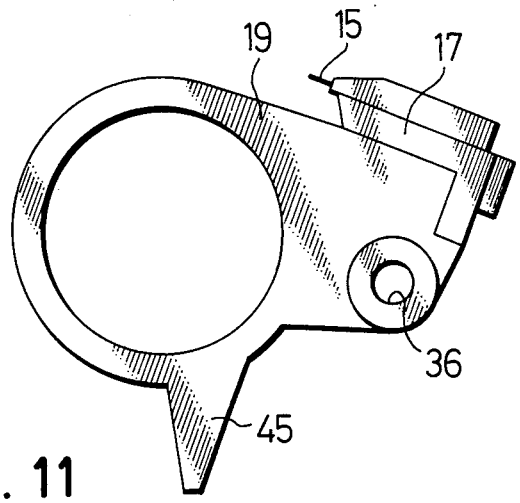
FIG. 10 is a front elevational view of a support arm for the righthand doctor blade for reverse rotation.

Third or trifurcate arms 28, 29 have annular proximal end portions fitted over the eccentric sleeves 24, 25. As shown in FIG. 8, each of the trifurcate arms 28, 29 has three arms extending radially outwardly from the proximal end portion thereof, the arms including a righthand blade actuator arm 28*a*, a lefthand blade actuator arm 28*b*, and a displacement transmitting arm 28*c*. The displacement transmitting arm 28*c* is coupled through a link 30 and an arm 31 to a cross shaft 32 which is coupled through an arm 33 at one end thereof to a single actuator 34 such as a pneumatic cylinder. Therefore, the displacement transmitting arm 28*c* is angularly movable reciprocably in response to reciprocating displacement of the cylinder 34.

The arms 18, 20, 28; 19, 21, 29 juxtaposed on the eccentric sleeves 24, 25, respectively, may be arranged in any desired order. In an embodiment shown in FIGS. 5 through 7, the trifurcate arms 28, 29 are positioned outwardly of the other arms, while in an embodiment of FIGS. 1 through 4, the trifurcate arm 28 is positioned inwardly of the other arms. The requirement is that the displacement from the single actuator 34 be transmitted through the trifurcate arms 28, 29 to the lefthand blade support arms 18, 19 when the mesh roller 13 is to rotate clockwise or to the righthand blade support arms 20, 21 when the mesh roller 13 is to rotate counterclockwise, through switching operation of a clutch which comprises a pin clutch mechanism according to the illustrated embodiment.

The support arm 20 for the righthand doctor blade 15 and the righthand blade actuator arm 28*a* of the trifurcate arm are interconnected by a pin 37 inserted in holes 35, 36 defined in distal ends of the arms 20, 28*b*. The support arm 20 and the righthand blade actuator arm 28*a* can be disconnected by retracting the pin 37 into one of these holes 35, 36 out of the other.

The support arm 18 for the lefthand doctor blade 14 and the lefthand blade actuator arm 28*b* of the trifurcate arm are interconnected by a pin 40 inserted in holes 38, 39 defined in distal ends of the arms 20, 28*b*. The support arm 18 and the lefthand blade actuator arm 28*b* can be disconnected by retracting the pin 40 into one of these holes 38, 39 out of the other.

While in the illustrated embodiment the pin clutch mechanism that is easily manually actuatable is shown, the pin can automatically actuated electromagnetically.

Figure 2:
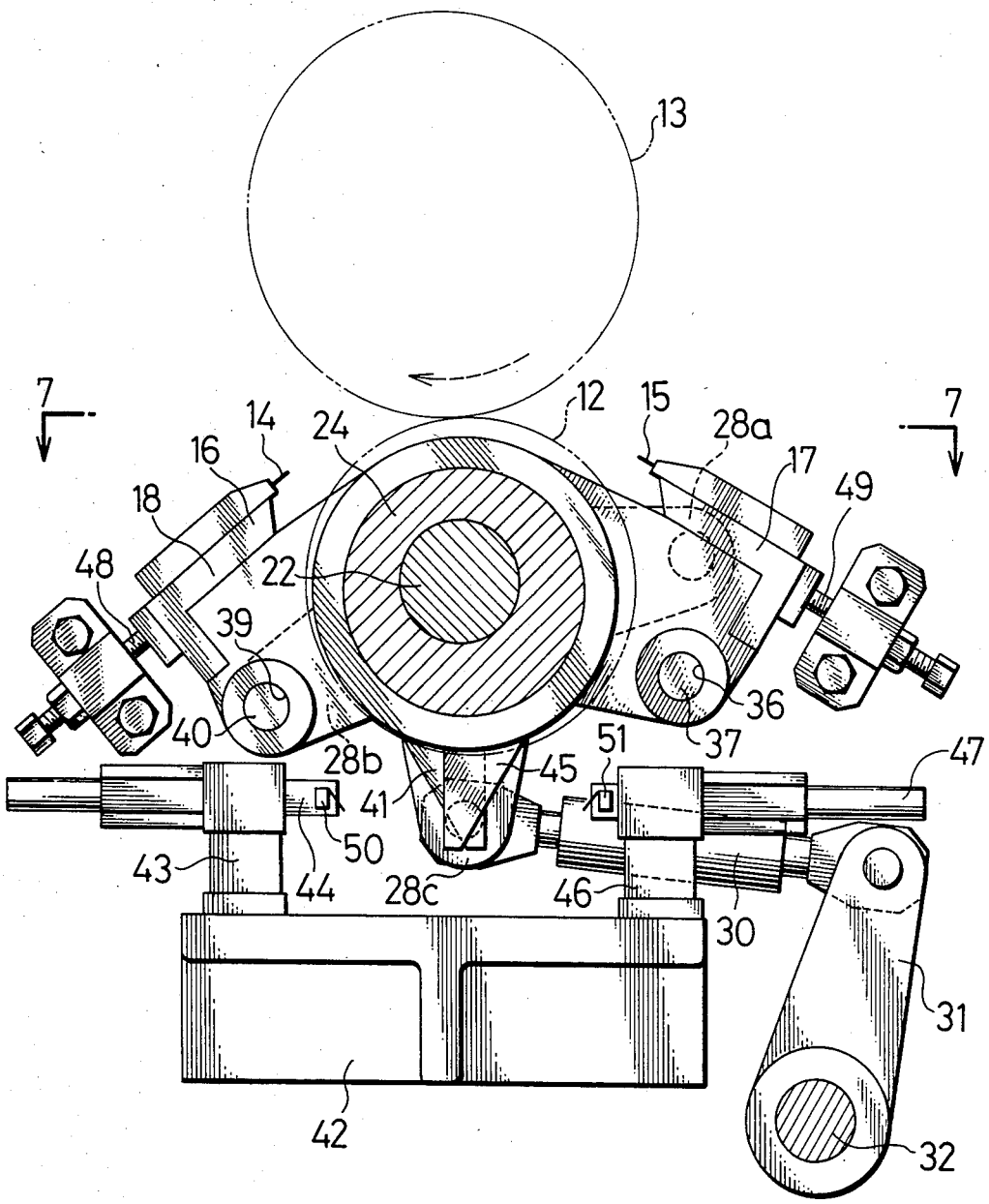
FIG. 2 is a view similar to FIG. 1, showing a clutch pin actuated for the lefthand doctor blade with respect to the mesh roller which has been switched for rotation in the normal rotation.

FIG. 2 shows the position in which the arms 18, 28*b* are interconnected by the lefthand pin 40. When the interconnection between the arms 18, 28*b* is completed, the pneumatic cylinder 34 is actuated to cause the arm 33, the cross shaft 32, the arm 31 and the link 30 to angularly displace the displacement transmitting arm 28*c* to the left. Then, as shown in FIG. 1, the lefthand doctor blade 14 is brought into contact with the peripheral surface of the mesh roller 13, whereupon ink can be scraped off during the nomal rotation of the mesh roller 13.

Figure 3:
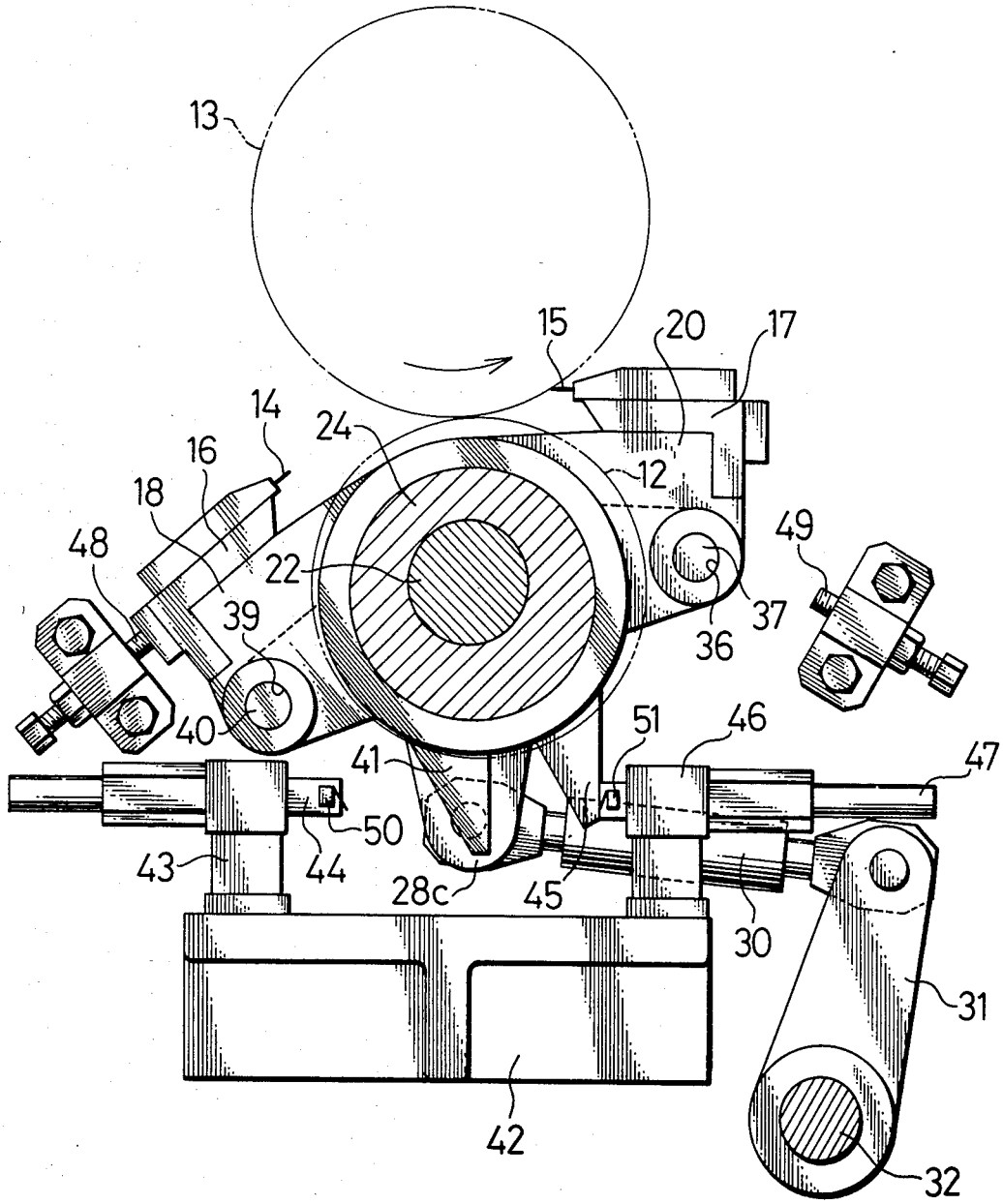
FIG. 3 is a view similar to FIG. 1, showing the righthand doctor blade for reverse rotation in contact with the mesh roller rotating in a reverse direction.
Figure 4:
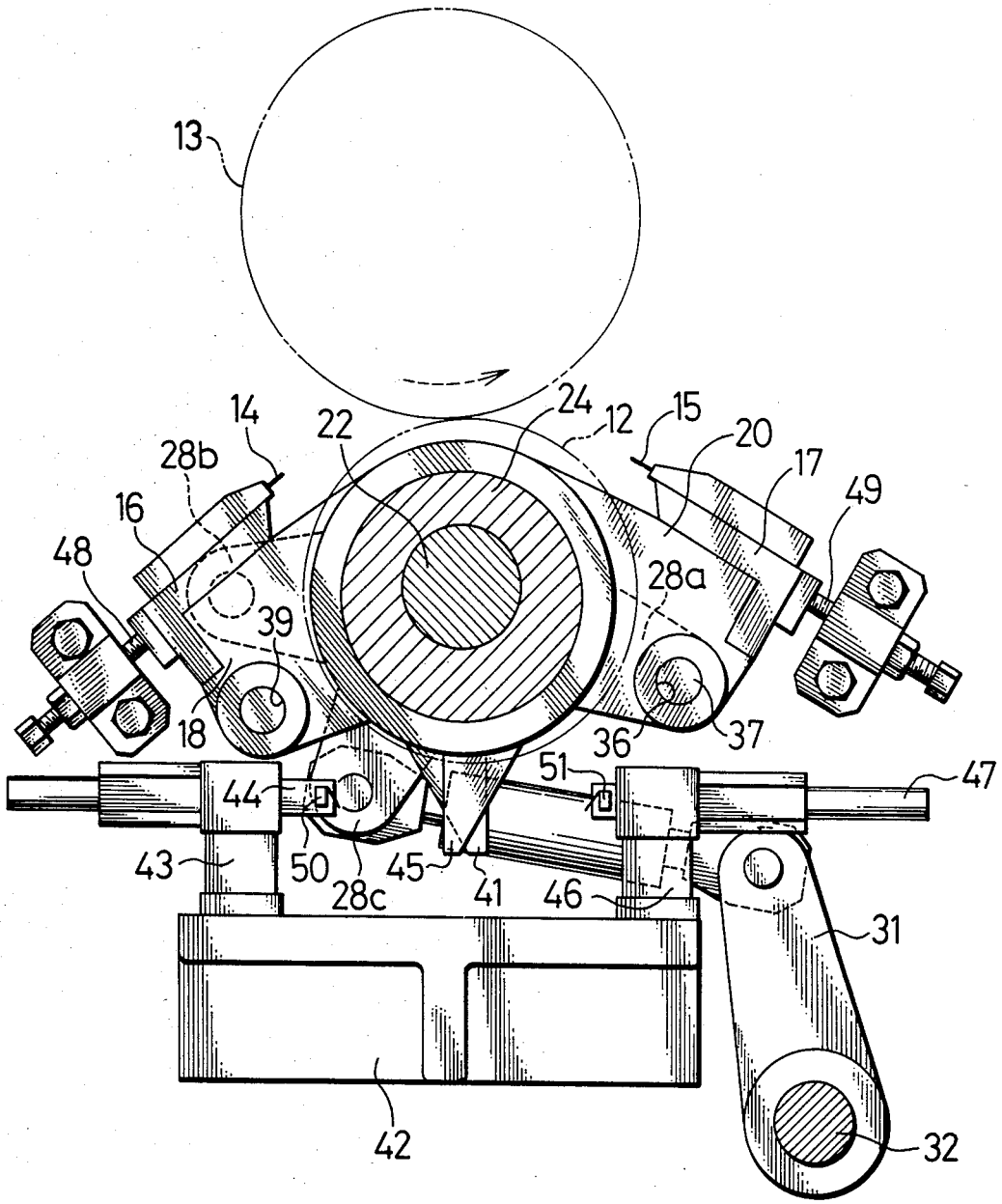
FIG. 4 is a view similar to FIG. 1, illustrating a clutch pin actuated for the righthand doctor blade with respect to the mesh roller which has been switched for rotation in the reverse direction.
Figures 5, 6:
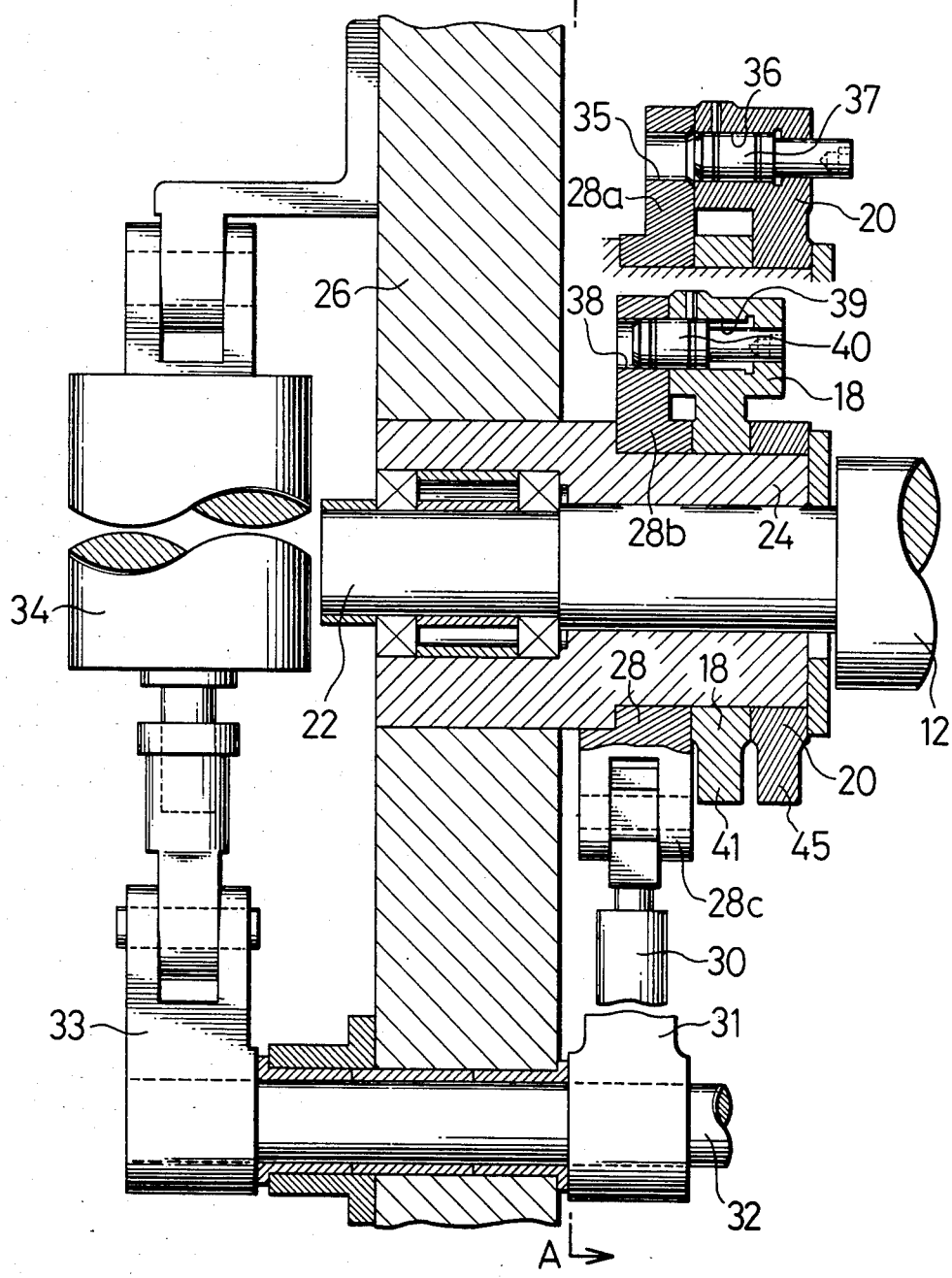
FIG. 5 is a horizontal developmental view taken along line 5—5 of FIG. 1.
FIG. 6 is a horizontal cross-sectional view taken along line 6—6 of FIG. 1.

FIG. 4 illustrates the position in which the arms 20, 28*a* are interconnected by the righthand pin 37. When the interconnection between the arms 20, 28*a* is completed, the pneumatic cylinder 34 is actuated to angularly displace the displacement transmitting arm 28*c* to the right. Then, as shown in FIG. 3, the righthand doctor blade 15 is brought into contact with the peripheral surface of the mesh roller 13, whereupon ink can be scraped off during the reverse rotation of the mesh roller 13.

The lefthand blade support arm 18 has a downwardly projecting finger 41 for adjusting the pressure of contact of the doctor blade 14 against the mesh roller 13. The finger 41 abuts against the distal end of an adjustment screw rod 44 threaded through a bracket 43 mounted on a base 42. The angular position in which the finger 41 is held at rest can be adjusted by displacing the screw rod 44 back and forth, so that the lefthand doctor blade 14 is pressed against the mesh roller 13 under an adjusted pressure. Likewise, the righthand blade support arm 20 has a downwardly projecting finger 45 for adjusting the pressure of contact of the doctor blade 15 against the mesh roller 13. The finger 45 is positionally adjustable by displacing an adjustment screw rod 47 threaded through a bracket 46 on the base 42 for varying the pressure of contact with which the righthand doctor blade 15 is held against the mesh roller 13.

The pin holes in the blade support arms 18, 20 are adjustable for alignment by lefthand and righthand stops 48, 49. Through fine adjustment of the stops 48, 49, the holes 39, 36 in the arms 18, 29 are brought into registry with the holes 38, 35, respectively, in the trifurcate arm 28.

The righthand pin clutch is actuatable in FIGS. 1 and 4, and the lefthand pin clutch is actuatable in FIGS. 2 and 3. The pins 40, 37 are in their connecting positions respectively on the lefthand blade support arm 18 of FIG. 1 and the righthand blade support arm 20 of FIG. 3. The pins 37, 40 are in their disconnecting positions respectively on the righthand blade support arm 20 of FIG. 2 and the lefthand blade support arm 18 of FIG. 4.

If the pairs of arms 20, 28*a* and 18, 28*b* connectable by the pins 37, 40 were integrally constructed, the doctor blades could easily be cleaned, replaced or inspected since when one arm pair is actuated, the other arm pair is always lowered to the retracted position. However, it is preferred that both the doctor blades 14, 15 be spaced from the periphery of the mesh roller 13 for inspecting, maintaining and replacing the mesh roller 13 or adjusting the pressure of contact against the fountain roller. To meet this requirement, the arms should be disconnectable by withdrawal of the pins as shown in FIGS. 2 and 4.

If the doctor blades 14, 15 were angularly spaced from each other by a constant angular interval at all times, then it would be impossible to effect individual adjustment of the pressure of contact of the doctor blades against the mesh roller 13, with a resulting failure in smooth operation to scrape ink off the mesh roller 13. Therefore, the support arms are provided respectively for the support arms so that the doctor blades can separately be adjusted in angular positions thereof and their pressures of contact against the mesh roller can independently be changed.

The foregoing constuction allows ink to be scraped off the mesh roller effectively provided the operating procedure is proper. However, when the wrong doctor blade is brought into contact with the mesh roller, or when the printing unit is operated while both the doctor blades are out of contact with the mesh roller, through an erroneous operating process, no ink can be scraped off, and a large amount of ink is supplied to the plate cylinders to thereby blacken the print paper with the ink. The large amount of ink applied to the print paper causes the paper to stick around a guide roller or a folding cylinder, or is scattered around to smear surroundings.

Figure 11:
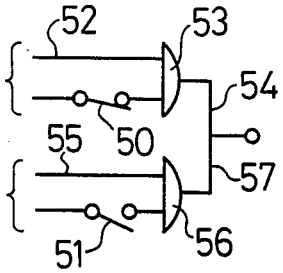
FIG. 11 is a circuit diagram for a safety circuit for protection against erroneous switching operation.

A safety circuit for protection against the above troubles is illustrated in FIG. 11. The safety circuit has a pair of limit switches 50, 51 (FIGS. 1 through 4 and 11) for detecting the lefthand doctor blade 14 and the righthand doctor blade 15 in their positions in which they contact the periphery of the mesh roller 13 and are readied for scraping ink off the mesh roller 13. The limit switches 50, 51 are positioned in alignment with the distal ends of the screw rods or stops 44, 47 which the fingers 41, 45 engage, respectively. When the lefthand doctor blade 14 is in the operated position, the lefthand limit switch 50 is closed to issue a signal. Since the righthand limit switch 51 is open at this time, it produces no signal. When the righthand doctor blade 15 is actuated, the righthand limit switch 51 is closed to generate a signal, but the lefthand limit switch 50 fails to issue any signal.

A power switching clutch (not shown) can produces a signal indicative of a normal rotation mode of a gear train (not shown) for driving all of the cylinders including the plate cylinder and the impression cylinder, and another signal indicative of a reverse rotation mode of such a gear train.

As illustrated in FIG. 11, the safety circuit also includes an AND gate 53 for producing a drive command signal 54 when it is supplied with an output signal from the limit switch 50 as it detects the lefthand doctor blade 14 in the actuated position and a signal 52 representative of the normal rotation mode of the gear train, and an AND gate 56 for producing a drive command signal 57 when it is supplied with an output signal from the limit switch 51 as it detects the righthand doctor blade 15 in the actuated position and a signal 55 representative of the reverse rotation mode of the gear train. The safety circuit allows the rotary printing press to be started only when the drive command signal 54 or 57 is applied. Therefore, the foregoing troubles are eliminated by the safety circuit since the rotary printing press is not driven unless the above dried command signal is applied.

Thus, the present invention can change both blades and rotation direction by a selective clutch operation whether the first doctor blade 14 or the second doctor blade 15 is in use and whether the normal or reverse rotation of the mesh roller 13 is occuring.

The conversion mechanism is simple, low cost, and easy to use, inspect, repair or exchange.

The safety circuit in the present invention can not only prevent mis-selection of the blades and driving direction, but can also stop the drive of the printing unit during the changing operation.

What is claimed is:

1. A convertible ink scraper device corresponding to a reverse-rotatable mesh roller comprising:

a fountain roller for picking up ink from an ink pan;

a mesh roller being spaced slightly from said fountain roller and having minute recesses defined in a peripheral surface thereof;

first and second doctor blades disposed in symmetrical locations one on each side of a position in which said mesh roller is disposed adjacent to said fountain roller, and each said doctor blade having a distal end confronting and pressable against said mesh roller;

switch means for independently displacing the doctor blades so as to selectively engage either one or neither of said doctor blades with said mesh roller, means for driving said mesh roller in either a normal or reverse direction, said means for driving including clutch means for selectively rotating said mesh roller in either the normal or reverse direction.

2. A convertible ink scraper device corresponding to a reverse-rotatable mesh roller comprising:

a fountain roller for picking up ink from an ink pan;

a mesh roller being spaced slightly from said fountain roller and having minute recesses defined in a peripheral surface thereof;

first and second doctor blades disposed in symmetrical locations one on each side of a position in which said mesh roller is disposed adjacent to said fountain roller, and each said doctor blade having a distal end confronting and pressable against said mesh roller;

a pair of mount bases on which said doctor blades are supported, respectively;

a pair of eccentric sleeves carrying a pair of axial opposite shafts supporting the fountain roller;

two pairs of first and second blade support arms having distal ends supporting said mount bases at ends thereof and annular proximal portions rotatably fitted over said eccentric sleeves;

a pair of trifurcate arms for switching between rotations in the normal and reverse directions, each of said trifurcate arms being composed of an annular proximal portion rotatably fitted over one of said eccentric sleeves, a first-doctor-blade actuator arm projecting radially outwardly from said annular proximal portion, a second doctor-blade actuator arm projecting radially outwardly from said annular proximal portion, and a displacement transmitting arm projecting radially outwardly from said annular proximal portion;

a single actuator connected through a linkage to said displacement transmitting arm for angularly moving the latter through a predetermined angular interval;

a first clutch mechanism for connecting and disconnecting said first blade support arms and said first-doctor-blade actuator arm; and a second clutch mechanism for connecting and disconnecting said second blade support arms and said second-doctor-blade actuator arm.

3. A convertible ink scraper device for a printing press including a driving system for the press rollers and corresponding to a reverse-rotatable mesh roller comprising;

a fountain roller for picking up ink from an ink pan;

a mesh roller being spaced slightly from said fountain roller and having minute recesses defined in a peripheral surface thereof;

first and second doctor blades disposed in symmetrical locations one on each side of a position in which said mesh roller is disposed adjacent to said fountain roller, and each said doctor blade having a distal end confronting and pressable against said mesh roller;

a pair of mount bases on which said doctor blades are supported, respectively;

a pair of eccentric sleeves carrying a pair of axial opposite shafts supporting the fountain roller;

two pairs of first and second blade support arms having distal ends supporting said mount bases at ends thereof and annular proximal portions rotatably fitted over said eccentric sleeves;

a pair of trifurcate arms for switching between rotations in the normal and reverse directions, each of said trifurcate arms being composed of an annular proximal portion rotatably fitted over one of said eccentric sleeves, a first-doctor-blade actuator arm projecting radially outwardly from said annular proximal portion, a second-doctor-blade actuator arm projecting radially outwardly from said annular proximal portion, and a displacement transmitting arm projecting radially outwardly from said annular proximal portion;

a single actuator connected through a linkage to said displacement transmitting arm for angularly moving the latter through a predetermined angular interval;

a first clutch mechanism for connecting and disconnecting said first blade support arms and said first-doctor-blade actuator arm;

a second clutch mechanism for connecting and disconnecting said second blade support arms and said second-doctor-blade actuator arm; and a safety circuit having a first detector for producing a first output signal indicative of a condition in which said second doctor blade is in a first position and a second detector for producing a second output signal indicative of a condition in which said first doctor blade is in a second position, said safety circuit being energizable to enable said driving system to operate either when said safety circuit is supplied with both said first output signal and a signal representative of a normal rotation mode of a gear train in said driving system, or when said safety circuit is supplied with both said second output signal and a signal representative of a reverse rotation mode of said gear train.

* * * * *